US007131557B2

(12) United States Patent
Zimmerman et al.

(10) Patent No.: US 7,131,557 B2
(45) Date of Patent: Nov. 7, 2006

(54) SINGLE PUMP WATER GUN WITH ADJUSTABLE FORCE PRESSURE CHAMBER

(75) Inventors: Jeffrey C. Zimmerman, King of Prussia, PA (US); Chor Ming Ken Ma, Shatin (HK)

(73) Assignee: Buzz Bee Toys, Inc., Mt. Laurel, NJ (US)

( * ) Notice: Subject to any disclaimer, the term of this patent is extended or adjusted under 35 U.S.C. 154(b) by 463 days.

(21) Appl. No.: 10/768,224

(22) Filed: Jan. 30, 2004

(65) Prior Publication Data

US 2005/0167441 A1 Aug. 4, 2005

(51) Int. Cl.
*A63H 3/18* (2006.01)

(52) U.S. Cl. ..... 222/79; 222/401

(58) Field of Classification Search ..... 222/79, 222/401

See application file for complete search history.

(56) References Cited

U.S. PATENT DOCUMENTS 4,135,559 A 1/1979 Barnby
5,799,827 A 9/1998 D'Andrade
5,826,750 A * 10/1998 Johnson ..... 222/79
5,878,914 A 3/1999 Johnson

* cited by examiner

*Primary Examiner*—Philippe Derakshani
(74) *Attorney, Agent, or Firm*—Volpe and Koenig, P.C.

(57) ABSTRACT

A toy water gun having a water supply tank which can be filled with water, and a water pump located on the housing for pumping water from the supply tank to at least one water pressure chamber. The water pressure chamber includes a fixed wall, and a moveable wall which substantially sealingly engages the fixed wall and is slidable away from a first end wall as water is pumped into the water pressure chamber and toward it as water is discharged. An air pressure chamber is located on an opposite side of the moveable wall from the water pressure chamber and is pressurizable with compressed air to bias the moveable wall toward the first end wall. A pump is connected to a selector valve assembly which, in a first state, allows air to be pumped into the air pressure chamber for pressurizing it with compressed air and, in a second state, places the pump in communication between the water supply tank and the water pressure chamber to allow water to be pumped from the supply tank to the water pressure chamber. Upon actuation of a release valve, the air pressure acts on the moveable wall to force water under pressure from the water pressure chamber so that a stream of water is ejected.

16 Claims, 7 Drawing Sheets

SINGLE PUMP WATER GUN WITH ADJUSTABLE FORCE PRESSURE CHAMBER

BACKGROUND

The present invention is directed to a water gun and more particularly, to a water gun having a pressure chamber into which water is pumped and held under pressure for release from the water gun.

Toy water guns are known which utilize pressurized air or a pressurized bladder as the motive force for discharging water from the gun upon release of a nozzle valve. U.S. Pat. No. 4,135,559 describes a water toy and fill valve combination. The water toy includes a resiliently expandable tubular bladder which serves as the pressurized water reservoir and the motive member for discharging water from the gun. Pressurized water is loaded into the bladder via the fill valve combination such that the bladder expands due to water pressure of the water from the fill valve. A trigger is provided which is connected to a release valve is provided for allowing water to be ejected from the toy water gun.

U.S. Pat. No. 5,799,827 discloses a similar water gun having a tubular bladder arranged in a tubular holding member. A separate water tank is located on the gun which holds water at ambient pressure. A pump located on the gun is utilized to transfer water from the ambient pressure water tank into the bladder, expanding the bladder. Upon release of a nozzle valve, water is ejected from the toy gun.

U.S. Pat. No. 5,878,914 discloses a similar toy water gun utilizing a water tank with water at ambient pressure, a pump and a balloon-shaped bladder located in a bladder chamber. Specialized valving means are provided to allow air drawn in to the pump from the water reservoir to be pumped back into the reservoir instead of the bladder. An alternate type of pressure chamber is also described in which the pressure chamber is formed by a spring-loaded wall which can be compressed within a chamber.

A drawback with these types of arrangements is that it is difficult and costly to produce a tubular or balloon-shaped bladder economically and with the desired characteristics to provide for fluid discharge with a relatively constant pressure during the entire discharge operation. Additionally, the elastic constant for the bladder material slowly degrades with age and use so that the bladder loses some elasticity over time. In the case of a spring-loaded wall type pressure chamber, the spring relaxes over time and therefore performance drops.

Additionally, it is difficult to provide a single elastic constant for the bladder or spring constant for a spring-walled chamber that allows for ease of use for both younger children, who have less strength to overcome the spring or elastic force to charge the pressure chamber, as well as higher performance for older children and teens who can apply more pumping force.

SUMMARY

Briefly stated, the present invention provides a toy water gun. The water gun includes a housing having a handle with a trigger as well as a barrel with a water ejection nozzle located thereon. A water supply tank is connected to the housing and can be filled with water. A water pressure chamber is provided that includes at least one fixed wall, a first end wall, and a moveable wall which substantially sealingly engages the at least one fixed wall and is slidable away from the first end wall as water is pumped into the water pressure chamber, and toward the first end wall as water is discharged. An air pressure chamber is located on an opposite side of the moveable wall from the water pressure chamber and is pressurizable with compressed air to bias the moveable wall toward the first end wall. A pump is connected to a selector valve assembly which, in a first state allows air to be pumped into the air pressure chamber for pressurizing the air pressure chamber, and in a second state, places the pump in communication between the water supply tank and the water pressure chamber to pump water from the supply tank to the water pressure chamber. A release valve is provided in fluid communication with the water pressure chamber. Actuation of the release valve allows a stream of water to be ejected from the nozzle due to the compressed air acting on the moveable wall.

In one preferred embodiment, the valve arrangement automatically switches from the first state to the second state once a predetermined air pressure is achieved in the air pressure chamber.

In another aspect of the invention, a release valve is provided for the release of air pressure from the air pressure chamber.

In another embodiment, the invention provides a pressurized water ejecting toy, which includes a water supply tank which can be filled with water. A water pressure chamber is provided that includes at least one fixed wall, a first end wall, and a moveable wall which substantially sealingly engages the at least one fixed wall and is slidable away from the first end wall as water is pumped into the water pressure chamber, and toward the first end wall as water is discharged. An air pressure chamber is located on an opposite side of the moveable wall from the water pressure chamber and is pressurizable with compressed air to bias the moveable wall toward the first end wall. A selector valve assembly is connected between the water supply tank, the water pressure chamber, the air pressure chamber and a pump. The selector valve assembly has a first state, in which air can be pumped into the air pressure chamber for pressurizing the air pressure chamber with compressed air and, a second state, in which the pump is placed in communication between the water supply tank and the water pressure chamber to allow water to be pumped from the supply tank to the water pressure chamber. A release valve is provided in fluid communication with the water pressure chamber so that actuation of the release valve allows a stream of water to be ejected due to compressed air acting on the moveable wall.

This arrangement allows the pressurized water ejecting toy to take the form of separately located components that are connected together by water and/or air carrying tubes or conduits, so that the shape and composition of the toy can be varied, for example, to provide a back-pack type water supply and pressure chamber arrangement that are located remotely from a trigger and/or nozzle used to eject water.

The invention has specific application in water guns that have a water chamber with a moveable wall in order to provide a user controlled amount of motive force to the water discharge.

BRIEF DESCRIPTION OF THE DRAWING(S)

The foregoing summary, as well as the following detailed description of the preferred embodiment of the present invention will be better understood when read in conjunction with the appended drawings. For the purposes of illustrating the invention, there is shown in the drawings an embodiment which is currently preferred. It should be understood, however, that the invention is not limited to the precise arrangement shown.

DETAILED DESCRIPTION OF THE PREFERRED EMBODIMENT(S)

Figure 1:
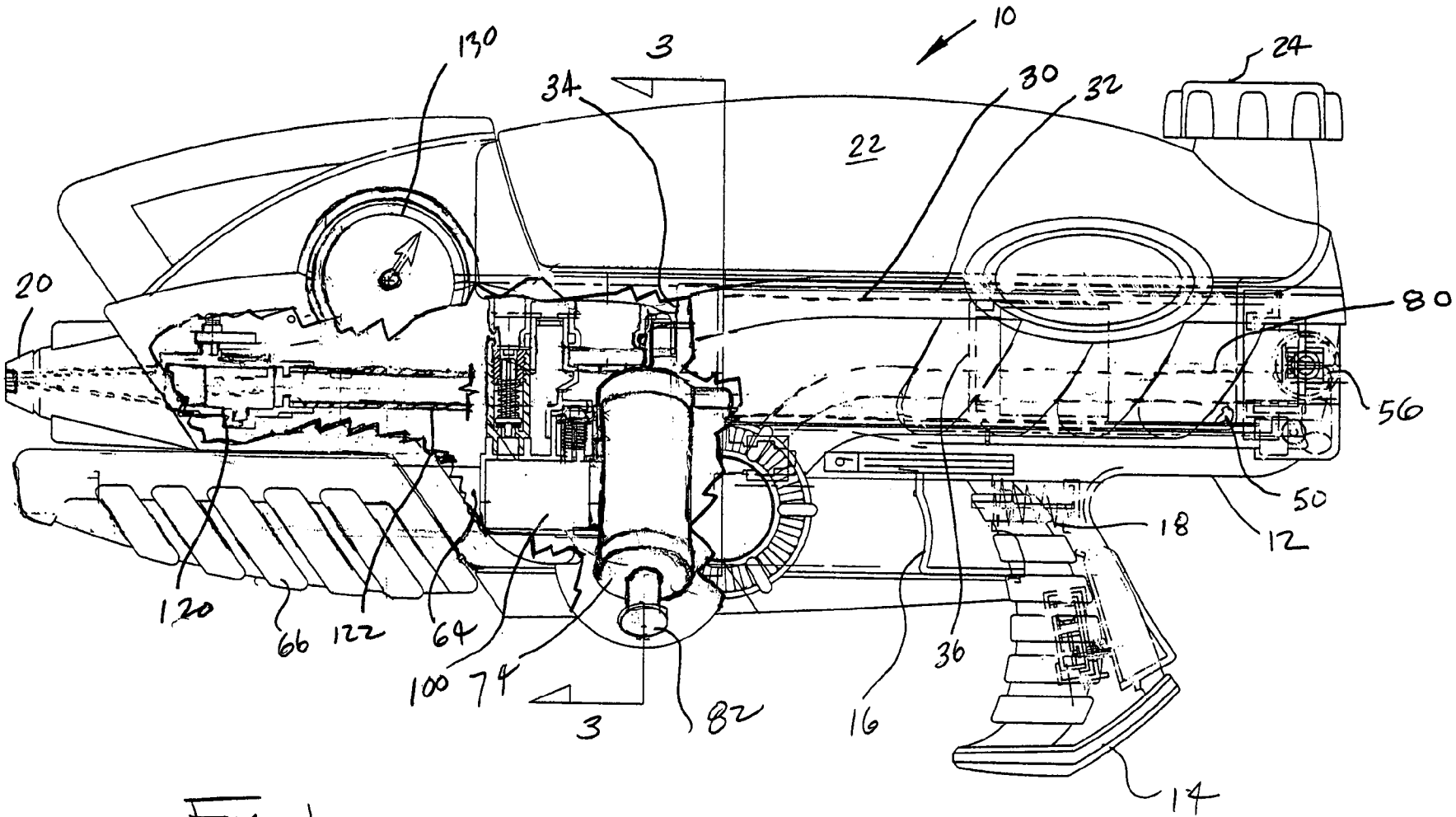
FIG. 1 is a side elevational view, partially broken away, of a water gun in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the toy water gun shown and designated parts thereof. The terminology includes the words above specifically mentioned, derivatives thereof and words of similar import.

Figure 2:
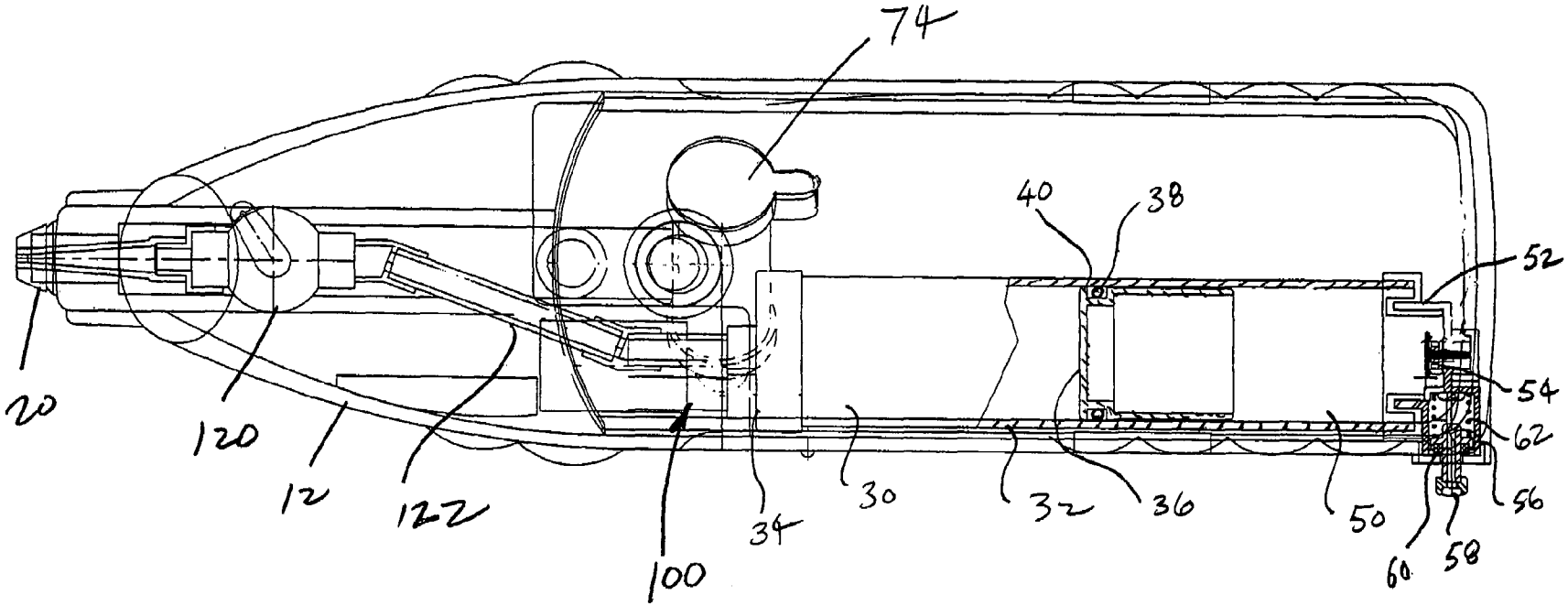
FIG. 2 is a top view of the embodiment of the water gun shown in FIG. 1, with the internal components being shown.
Figure 3:
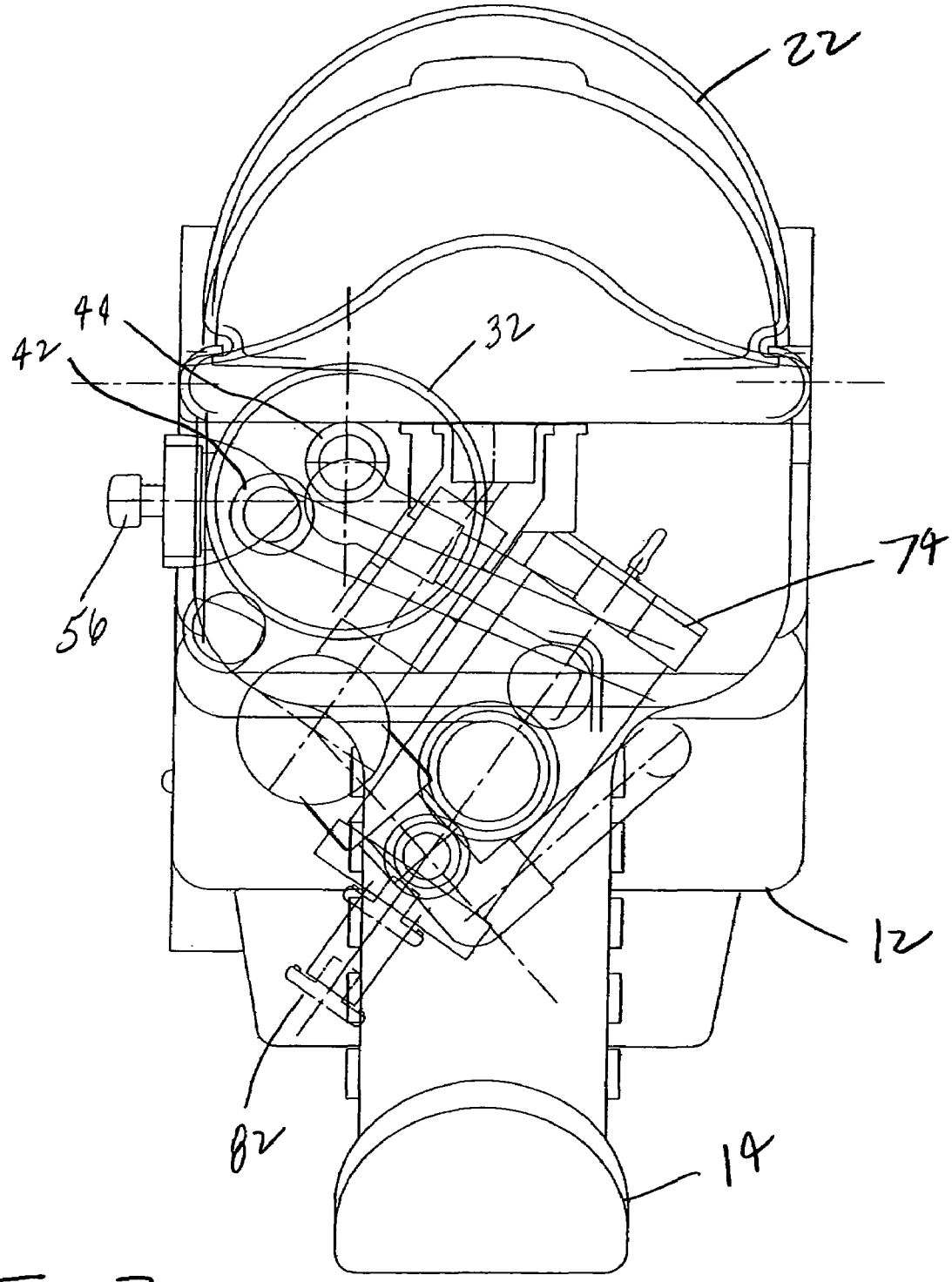
FIG. 3 is a sectional view, taken along line 3—3 in FIG. 1, showing the internal components of the water gun of FIG. 1.

Referring now to FIGS. 1–3, a first embodiment of a toy water gun 10 in accordance with the present invention is shown. The water gun 10 includes a housing 12 with a handle 14 having a trigger 16 located thereon. The housing 12 with the handle 14 is preferably molded from one or more pieces of a polymeric material which can be assembled together using adhesives, fasteners or any other suitable connectors, such as a snap fit between different pieces of the housing 12. The trigger 16 is preferably movably connected to the housing 12 adjacent to the handle 14 so that it can be depressed by a user. A trigger return spring 18, shown in dashed lines, is preferably provided so that the trigger 16 is biased to an outward position.

A water ejection nozzle 20 is preferably located at the front of the housing 12. The nozzle is preferably a single-orifice nozzle 20, as shown. However, it is possible to use multiple orifice nozzle arrangements which are rotateable in order to provide a different spray or water ejection pattern from the nozzle 20.

A water supply tank 22 is connected to the housing 12 and can be filled with water by removing a fill cap 24 located on the water supply tank 22. Preferably, the fill cap 24 is threadingly engaged to a fill opening in the water supply tank 22. However, it could be a snap-fit cap or other suitable closure.

Referring to FIGS. 1 and 2, a water pressure chamber 30 is located in the housing. The water pressure chamber 30 includes at least one fixed wall 32, which is preferably a tubular wall. A first end wall 34 is also provided, which preferably closes off a forward end of the tubular wall 32. The first end wall 34 may be in the form of a cap that is adhesively connected to a first end of the fixed wall 32. A movable wall 36 which substantially sealingly engages the at least one fixed wall 32 and is slideable away from the first end wall 34 is also provided. Preferably, the moveable wall 36 is cup-shaped, as shown most clearly in FIG. 2, and a seal 38 is located on an outer surface of the moveable wall 36, which sealingly and slideingly engages an inner surface of the tubular fixed wall 32. The seal 38 is preferably an O-ring seal located in a groove 40 located in an outwardly-facing portion of the cup-shaped moveable wall 36. The moveable wall 36 is slideable away from the first end wall 32 as water is pumped into the water pressure chamber 30 and is moveable towards the first end wall 32 as water is discharged from the water pressure chamber 30, as explained in more detail below.

In the preferred embodiment, the at least one fixed wall is a tube with a round cross-section. Preferably, the at least one fixed wall includes at least one water receiving and discharge opening 42, as shown in FIG. 3. More preferably, separate water receiving and water discharge openings 42, 44 are provided in the first end wall 32.

An air pressure chamber 50 is located on an opposite side of the moveable wall 36 from the water pressure chamber 30. The air pressure chamber 50 is pressurizable with compressed air to bias the moveable wall 36 towards the first end wall 32 as water is discharged. Preferably, the air pressure chamber 50 is formed via a second end wall 52 connected to a second end of the tubular fixed wall 32. Preferably, an opening 54 for pressurizing the air pressure chamber 50 with pressurized air is provided in the second end wall 52.

A pressure bleeder valve 56 is preferably also connected with the air pressure chamber 50. The pressure bleeder valve 56 preferably comprises a chamber connected with the air pressure chamber 50, which is sealed at one end using an actuator 58 having an O-ring seal 60 located thereon that is biased to a closed position via a spring 62. By pressing inwardly on the actuator 58, air pressure within the air pressure chamber 50 can be bled off and released.

As shown in FIG. 1, a pump 64 is preferably connected to the housing 12. The pump 64 preferably includes a handle 66, which can be manually grasped by a user in order to reciprocate a piston 68 back and forth in order to pump air or water as described in further detail below. The pump 64 is shown in detail in FIG. 4 with the handle 66 removed for clarity. The piston 68 is preferably mounted on a pump rod 70 and includes a polymeric or rubber sliding seal 72.

Figure 4:
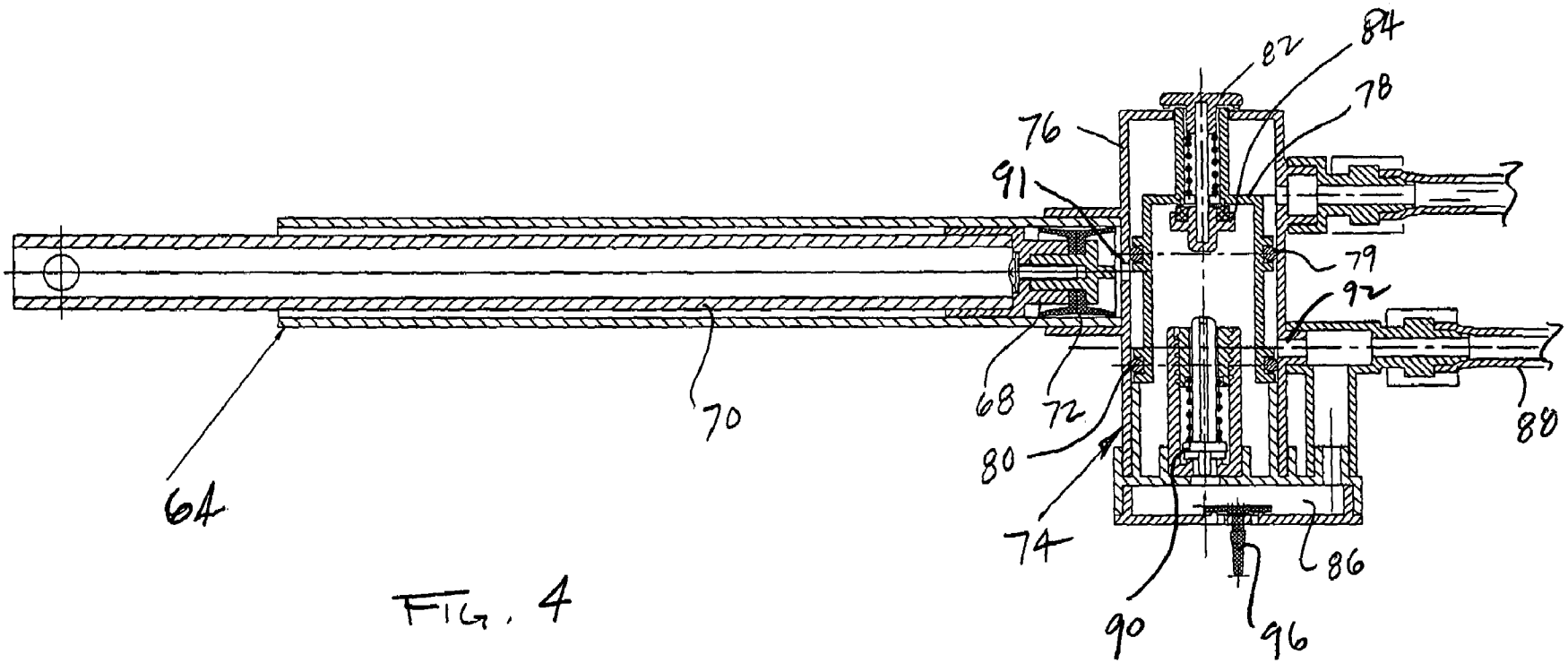
FIG. 4 is an enlarged view of the pump and selector valve assembly shown in FIG. 4.

Referring to FIGS. 1 and 4, a selector valve assembly 74 is connected to the pump 64. The selector valve assembly 74 allows air to be pumped from the pump 64 into the air pressure chamber 50 for pressuring the air pressure chamber 50 with compressed air in a first state. In a second state, the selector valve assembly 74 places the pump 64 in communication with the water supply tank 22 and the water pressure chamber 30 to allow water to be pumped from the supply tank 22 to the water pressure chamber 30. The second state of the selector valve assembly 74 is shown in FIG. 5.

Figure 5:
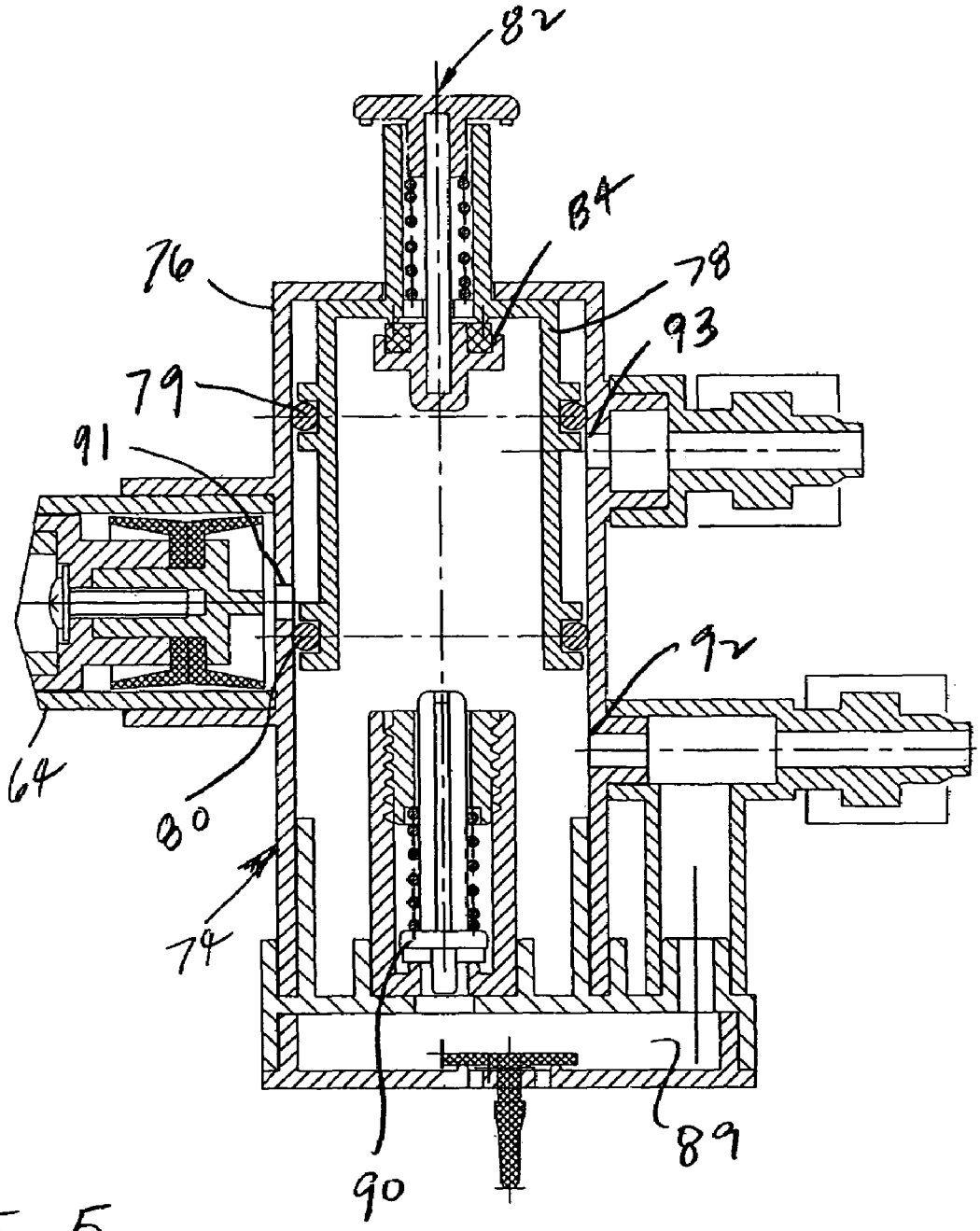
FIG. 5 is an enlarged view of the selector valve assembly of FIG. 5 shown in a second operating position.

Referring to FIGS. 4 and 5, the selector valve assembly 74 includes a housing 76, which is preferably cylindrical in form. A moveable piston 78 is located in the housing and includes two spaced-apart seals 79, 80 located thereon. An actuator 82 protrudes through the housing 76 and includes a release valve 84 in communication with a first side of the piston 78. In the first state, the piston 78 is located in a first position shown in FIG. 4, and can be moved there by pressing inwardly on the actuator 82.

The selector valve assembly housing 76 includes a valve air chamber 86 in communication with the air pressure chamber 50. This is preferably accomplished via an air pressure tube 88 connected between the selector valve assembly 74 and the air pressure chamber 50. When a predetermined air pressure in achieved in the air pressure chamber 50, pressurized air in the valve air chamber 86 opens an air release valve 90 so that the pressurized air acts on the first side of the piston 78 in order to force the piston 78 towards a second position, shown in FIG. 5, in which the actuator 82 protrudes outwardly from the selector valve assembly housing 76 to place the selector valve assembly in the second state. The air release valve 90 is preferably a spring loaded piston, as shown in detail in FIG. 5. However, other types of pressure actuated release valves can be utilized.

In the first state of the selector valve assembly 74 with the piston 78 in the first position, an annular space located between the sealing rings 79, 80 on the piston 78 is in communication between the pump 64 and the air pressure tube 88 via openings 91 and 92 in the housing 76. In the second state of the selector valve assembly 74 with the piston 78 in the second position, as shown in FIG. 5, the pump is placed in communication with water supply tank 22 and the water pressure chamber 30 via the annular space between the sealing ring 79 and 80 now providing a communication path between the pump opening 91 in the housing 76 and a third opening 93. The air pressure on the first side of the piston 78 can be released by pressing inwardly on the actuator 82, which opens the valve 84 and allows the piston 78 to be pushed downwardly so that the selector valve assembly is again returned to the first state. The air pressure release valve 90 is set to open upon a predetermined air pressure being achieved, for example, 30–-40 psi.

In order to allow air to be drawn in by the pump on an intake stroke, a flap valve formed from a rubber plug 96 is preferably located in the valve air chamber 86. When the pump handle is pulled outwardly, this allows air to be drawn in through the flap valve 96 via the pathway shown back through the openings 92 and 91 in the selector valve assembly housing 76 and into the chamber of the pump 64. As the pump piston 68 is pressed inwardly on the compression stroke, the air pressure travels back through the openings 91 and 92 and into the selector valve air chamber 86, forcing the flap valve 96 into a closed position so that pressurized air is delivered through the air pressure tube 88 to the air pressure chamber 50. Once the predetermined pressure level is reached, the air pressure forces the air pressure release valve 90 to open so that pressurized air is delivered into the space formed between the first side of the piston 78 and the inside of the selector valve assembly housing 76 in order to force the piston into the second position shown in FIG. 5 so that the selector valve assembly 74 is moved to the second state.

If pumping of the pump 90 continues with the selector valve 74 in the second state, water is drawn from the supply tank 22 in through the opening 93 and into the pump chamber via the opening 91. Upon a compression stroke of the pump piston 68, the water is forced back out of the pump chamber through the openings 91 and 93 in the selector valve assembly housing 76 and back to a transfer valve assembly 100, described in detail below, which directs the pressurized water to the water pressure chamber 30.

Figure 6:
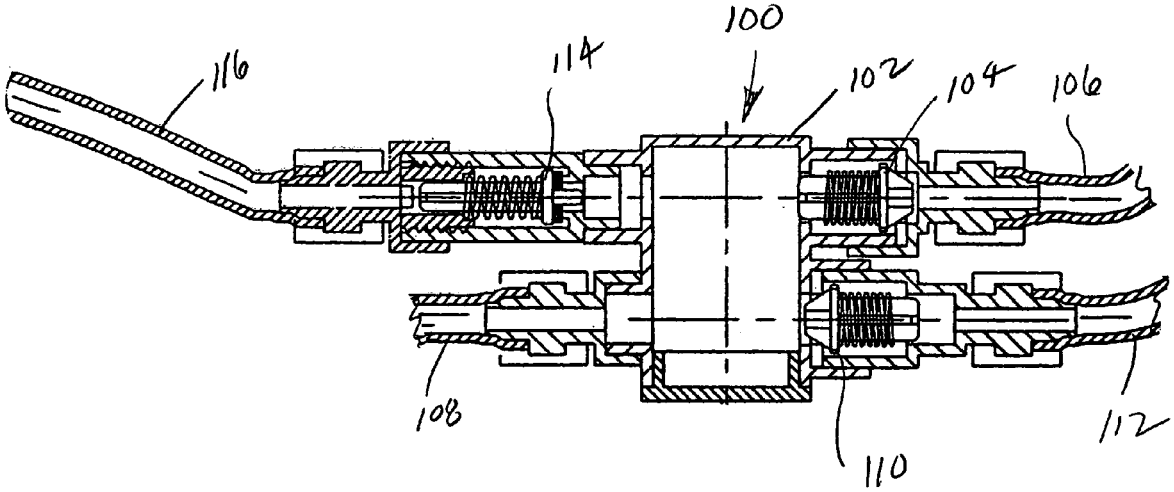
FIG. 6 is an enlarged view of a transfer valve assembly.

The transfer valve assembly 100 is shown in detail in FIG. 6 and is in communication between the water supply tank 22, the pump 64 and the water pressure chamber 30. The transfer valve assembly 100 includes a housing 102 having a first check valve 104 located between the transfer valve assembly 100 and the water supply tank 22 to only allow the flow of water from the water supply tank 22 through a first conduit 106 towards the pump, which is connected via a pump connection 108 to the transfer valve assembly 100. A second check valve 110 is located in a second supply conduit 112 to only allow the flow of water from the pump 64 to the water pressure chamber 30. The check valve 110 prevents a backflow of water into the transfer valve assembly 100 from the pressurized water chamber 30. A pressure relief valve 114 is also connected to the transfer valve assembly 100 and is connected via a third conduit 116 to the water supply tank 22. If excess pressurized water is pumped into the transfer valve assembly 100 when the pressurized water chamber 30 is filled to capacity, the relief valve 114 opens to discharge the excess pressurized water back into the water supply tank 22.

In use, the water supply tank 22 is filled with water by removing the cap 24. The actuator 82 on the selector valve assembly 74 is pressed inwardly to place the selector valve assembly 74 in a first state which allows air to be pumped with the pump 64 via the air pressure tube 88 into the air pressure chamber 50. This is accomplished by pumping the pump handle 66, preferably between five and fifteen times, and more preferably between seven and ten times, in order to sufficiently pressurize the air pressure chamber 50 with pressurized air. When a predetermined air pressure has been reached, the selector valve assembly 74 automatically moves to a second state via air pressure acting upon the first surface of the piston 78 such that the piston 78 moves into a second position, as shown in FIG. 5, placing the pump 64 in communication with the water supply tank 22. Upon further pumping of the hand pump 64, preferably between one and five strokes, and more preferably 2–3 strokes, water is transferred from the water supply tank 22 via the first conduit 106 into the transfer valve assembly 100 and into the pump 64. The compression stroke of the pump 64 forces the water back into the transfer valve assembly 100, where the check valve 110 is opened via the water pressure, forcing the water through the second conduit 112 and into the water pressure chamber 30. When the water pressure chamber 30 is fully charged, additional pumping forces the pressure relief valve 114 to open, such that water is discharged via the third conduit 116 back into the water supply tank 22.

As shown in FIG. 1, a release valve 120 is in communication with the water pressure chamber 30 via a fourth conduit 122. Actuation of the release valve 120 allows a stream of water to be ejected from the nozzle 20 due to compressed air in the air pressure chamber 50 acting on the moveable wall 36, forcing water out of the water pressure chamber 30. Preferably, the release valve 120 is connected via a linkage with the trigger 16 such that actuating the trigger 16 causes the release valve 120 to open. Releasing the trigger 16 allows the release valve 120 to close.

The water gun shown in FIG. 1 may also include a pressure meter 130 to indicate a charge state of the water gun 10.

The water gun 10 provides the advantage that the air pressure chamber 50 can be charged to a predetermined level prior to automatic switching over of the pump 64 to charging the water pressure chamber 30 with water from the water supply tank 22. Additionally, the actuator 82 could be manually activated if a lower air pressure was desired for ease of pumping; for example, for children having less strength.

Figure 7:
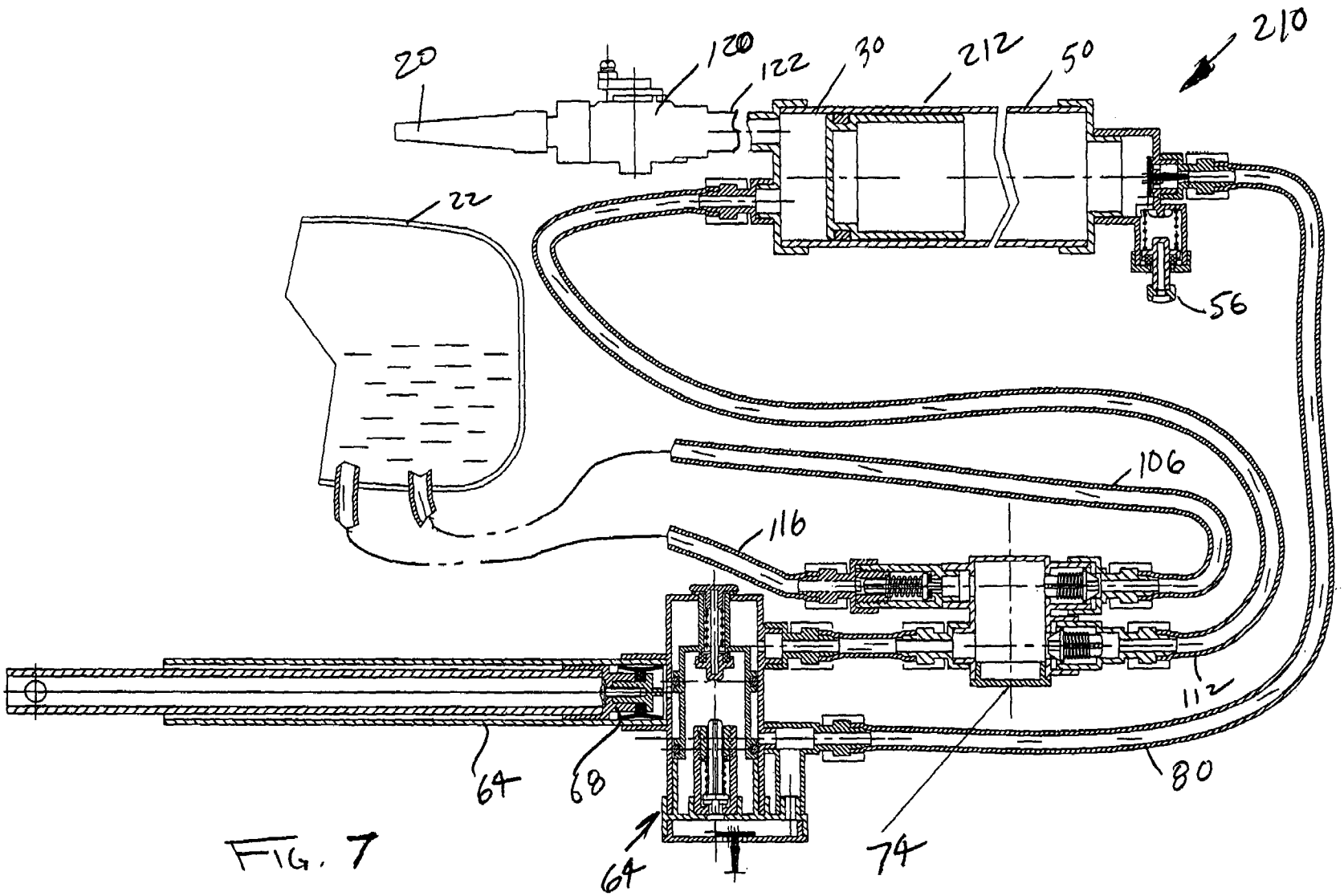
FIG. 7 is a diagrammatic view showing the functional components of a water ejecting toy in accordance with the present invention.

Referring now to FIG. 7, a diagrammatic drawing is provided of the major functional components of the water gun 10, which could also be utilized in a pressurized water-ejecting toy 210 in accordance with the present invention, in which all of the components are not required to be assembled into a single water gun housing. The components of the pressurized water-ejecting toy 210 are the same as those referenced above in connection with the water gun 10 and have been identified with the same reference numerals. These components include the water supply tank 22, the pump 64, the selector valve assembly 74, the transfer valve assembly 100 and the water and air pressure chambers 30, 50 formed by a pressure tube arrangement 212. The first, second, third and fourth conduits 106, 112, 116 and 122 are also provided in order to connect the components along with the air pressure tube 88. These components can be arranged in separate housings; for example, with the pressure tube assembly 212 and water tank 22 located remotely from the nozzle 20, with the fourth conduit 122 having a sufficient length in order to allow the nozzle 20 to be separately directed in a desired direction. Additionally, the nozzle 20 and pump 64 could be contained in a single smaller unit with the water supply tank 22 and/or the pressure tube assembly 212 being remotely located, if desired. The functional operation of the pressurized water ejecting toy 210 would be the same as described above in connection with the water gun 10.

While the preferred embodiment of the invention has been described in detail, the invention is not limited to the specific embodiments described above, which should be considered as merely exemplary. Further modifications and extensions of the present invention may be developed, and all such modifications are deemed to be within the scope of the present invention as defined above and by the appended claims.

What is claimed is:

1. A toy water gun, comprising:

a housing including a handle with a trigger and a water ejection nozzle located thereon;

a water supply tank connected to the housing which can be filled with water;

a water pressure chamber that includes at least one fixed wall, a first end wall, and a moveable wall which substantially sealingly engages the at least one fixed wall and is slidable away from the first end wall as water is pumped into the water pressure chamber and toward the first end wall as water is discharged;

an air pressure chamber located on an opposite side of the moveable wall from the water pressure chamber that is pressurizable with compressed air to bias the moveable wall toward the first end wall;

a pump and a selector valve assembly connected thereto which, in a first state, allows air to be pumped by the pump into the air pressure chamber for pressurizing the air pressure chamber with compressed air and, in a second state, places the pump in communication between the water supply tank and the water pressure chamber to allow water to be pumped by the pump from the supply tank to the water pressure chamber; and a release valve in fluid communication with the water pressure chamber so that actuation of the release valve allows a stream of water to be ejected from the nozzle due to the compressed air acting on the moveable wall.

2. The toy water gun of claim 1, wherein the selector valve assembly includes a manual actuator for placing the selector valve assembly in the first state.

3. The toy water gun of claim 1, wherein the selector valve assembly is moved automatically from the first state to the second state upon a predetermined air pressure level being attained in the air pressure chamber.

4. The toy water gun of claim 1, wherein the selector valve assembly includes a valve air chamber in communication with the air pressure chamber, and when a predetermined air pressure is achieved in the air pressure chamber, pressurized air in the valve air chamber automatically switches the valve assembly to the second state.

5. The toy water gun of claim 4, wherein an air pressure release valve is located in the valve air chamber, the air pressure valve being set to open upon a predetermined air pressure being achieved so that the air pressure acts upon a valve body in the selector valve assembly to move the valve body from a first position, in which the pump is in communication with ambience on an intake stroke and the air chamber on a compression stroke, to a second position, in which the pump is in communication with the water supply tank on the intake stroke and the water pressure chamber on the compression stroke.

6. The toy water gun of claim 4, wherein when the selector valve assembly is moved from the second state to the first state, existing air pressure within the air pressure chamber is released.

7. The toy water gun of claim 4, further comprising a transfer valve assembly in communication between the water supply tank, the pump, and the water pressure chamber, the transfer valve assembly including a check valve located between the transfer valve assembly and the water supply tank to only allow flow of water from the water supply tank through a first conduit toward the pump, and a second check valve located in a second supply conduit to only allow flow of water from the pump to the water pressure chamber.

8. The toy water gun of claim 7, further comprising a third conduit located between the transfer valve assembly and the water supply tank, and a pressure release valve located in the third conduit to discharge excess pressurized water from the water pressure chamber back into the water supply tank.

9. The toy water gun of claim 1, further comprising an air pressure release valve in communication with the air pressure chamber.

10. The toy water gun of claim 1, wherein the fixed wall is tubular and the moveable wall is cup-shaped, and a seal is located on an outer surface of the moveable wall which sealingly and slidingly engages an inner surface of the fixed wall.

11. A pressurized water ejecting toy, comprising:

a water supply tank which can be filled with water;

a water pressure chamber that includes at least one fixed wall, a first end wall, and a moveable wall which substantially sealingly engages the at least one fixed wall and is slidable away from the first end wall as water is pumped into the water pressure chamber and toward the first end wall as water is discharged;

an air pressure chamber located on an opposite side of the moveable wall from the water pressure chamber that is pressurizable with compressed air to bias the moveable wall toward the first end wall;

a selector valve assembly connected between the water supply tank, the water pressure chamber, the air pressure chamber and a pump, the selector valve assembly having a first state, in which air can be pumped into the air pressure chamber for pressurizing the air pressure chamber with compressed air, and a second state, in which the pump is in communication between the water supply tank and the water pressure chamber to allow water to be pumped from the supply tank to the water pressure chamber; and a release valve in fluid communication with the water pressure chamber so that actuation of the release valve allows a stream of water to be ejected due to compressed air acting on the moveable wall.

12. The toy of claim 11, wherein the selector valve assembly includes a manual actuator for movement to the first state.

13. The toy of claim 11, wherein the selector valve assembly is moved automatically from the first state to the second state upon a predetermined air pressure level being attained in the air pressure chamber.

14. The toy of claim 11, wherein the selector valve assembly includes a valve air chamber in communication with the air pressure chamber, and when a predetermined air pressure is achieved in the air pressure chamber, pressurized air in the valve air chamber automatically switches the valve assembly to the second state.

15. The toy of claim 14, wherein an air pressure valve is located in the valve air chamber, the air pressure valve being set to open upon a predetermined air pressure being achieved so that the air pressure acts upon a valve body in the selector valve assembly to move the valve body from a first position, in which the pump is in communication with ambience on an intake stroke and the air chamber on a compression stroke, to a second position, in which the pump is in communication with the water supply tank on the intake stroke and the water pressure chamber on the compression stroke.

16. The toy of claim 14, wherein when the selector valve assembly is moved from the first state to the second state, existing air pressure within the air pressure chamber is released.

* * * * *